US007329863B2

(12) United States Patent
Kalinitchenko

(10) Patent No.: US 7,329,863 B2
(45) Date of Patent: Feb. 12, 2008

(54) MASS SPECTROMETRY APPARATUS AND METHOD

(75) Inventor: Iouri Kalinitchenko, Berwick (AU)

(73) Assignee: Varian Australia Pty, Ltd., Mulgrave, Victoria (AU)

( * ) Notice: Subject to any disclaimer, the term of this patent is extended or adjusted under 35 U.S.C. 154(b) by 401 days.

(21) Appl. No.: 10/523,186

(22) PCT Filed: Jul. 29, 2003

(86) PCT No.: PCT/AU03/00955

§ 371 (c)(1),
(2), (4) Date: Jan. 28, 2005

(87) PCT Pub. No.: WO2004/012223

PCT Pub. Date: Feb. 5, 2004

(65) Prior Publication Data

US 2005/0269506 A1 Dec. 8, 2005

(30) Foreign Application Priority Data

Jul. 31, 2002 (AU) ..... 2002950505

(51) Int. Cl.
*H01J 49/00* (2006.01)

(52) U.S. Cl. ..... 250/288; 250/281; 250/282

(58) Field of Classification Search ..... 250/288
See application file for complete search history.

(56) References Cited

U.S. PATENT DOCUMENTS 4,948,962 A 8/1990 Mitsui et al.

6,259,091 B1 7/2001 Eiden et al.

(Continued)

FOREIGN PATENT DOCUMENTS

JP 10040857 A 2/1998

(Continued)

OTHER PUBLICATIONS

Article by R.S.Houk, JS Crain and JT Rowan, entitled "What can be done about spectral overlap interferences in ICP-MS", Abstracts, 1986 Winter Conference on Plasma Spectrochemistry, Kailua-Kona, Hawaii, USA, Jan. 2-8, 1986 p. 35.

(Continued)

*Primary Examiner*—Nikita Wells
*Assistant Examiner*—Phillip A. Johnston
(74) *Attorney, Agent, or Firm*—Bella Fishman; Edward H. Berkowitz

(57) ABSTRACT

A mass spectrometer in which a substance is introduced into a plasma (28) which contains analyte ions as the plasma (28) is passing through an aperture (42), for example in a skimmer cone (40) between two vacuum regions (38) and (44) so that the substance interacts with the plasma (28) thereby reducing the concentration of interfering polyatomic or multicharged ions in the plasma by reactive or collisional interactions. The substance may be supplied via passage (60) having an outlet (63) in skimmer cone (40). The invention gives improved attenuation of interfering ions because the substance is supplied directly into the plasma (28) as it is substantially radially confined by aperture (42) and before an ion beam (58) is extracted. Alternatively or additionally a substance may be supplied directly into the plasma within aperture (36) in sampling cone (34).

20 Claims, 7 Drawing Sheets

U.S. PATENT DOCUMENTS 6,265,717 B1 * 7/2001 Sakata et al. ..... 250/289
6,462,336 B1 * 10/2002 Bajic ..... 250/288

FOREIGN PATENT DOCUMENTS

WO WO 02/19382 A2 3/2002
WO WO 03/023815 A1 3/2003

OTHER PUBLICATIONS

Artucle by Christopher Ingle, et al. entitled The use of background ions and multivariate approach to characterise and optimise the dominate HS-based chemistries in a hexapole collision cell used in ICP-MS; Journal of Analytical Atomic Spectrometry, vol. 16, (2001), pp. 1076-1084.

* cited by examiner

MASS SPECTROMETRY APPARATUS AND METHOD

TECHNICAL FIELD

The present invention relates to a mass spectrometer and a method for mass spectrometry including a plasma ion source for providing analyte ions. The plasma ion source may be an inductively coupled plasma (ICP), a microwave induced plasma (MIP) or other suitable plasma ion source.

BACKGROUND

A problem in elemental mass spectrometry is the presence of polyatomic and multicharged ion interferences having the same masses as isotopes to be measured. For example, in plasmas sustained in argon, argon-based interfering ions such as $Ar^+$, $Ar_2^+$, $ArO^+$, $ArOH^+$ have masses that overlap with the masses of isotopes of Ca, Fe, Se, which makes it difficult to produce reliable analytical results for trace amounts of such isotopes.

Known methods for attenuating interfering polyatomic or multicharged ions have involved promoting reactive (that is, ion-molecule charge transfer reactions) and collisional decomposition of the interferences via the use of mixed gas plasmas, such as the addition of hydrogen to the argon conventionally used in ICP-MS, and the use of various collision or reaction cells that may contain selected reactive or collision gases. It is also known to promote reactive (charge transfer) and collisional decomposition of interfering ions in the region of the interface between a plasma ion source and mass analyser, for example in the region of the sampling-skimmer cone interface in an inductively coupled plasma mass spectrometer (ICP-MS). For example, as long ago as 1986 R. S. Houk and colleagues listed "adding a foreign gas (e.g. Xe) into the ICP or vacuum system to react with and remove the undesired ion" as one approach to solving the problem of spectral overlap interferences in ICP-MS. (R. S. Houk, J. S. Crain, and J. T. Rowan, "What can be done about spectral overlap interferences in ICP-MS", Abstracts, 1986 Winter Conference on Plasma Spectrochemistry, Kailua-Kona, Hi., USA, Jan. 2-8, 1986, p. 35). For another example U.S. Pat. No. 4,948,962 entitled "Plasma Ion Source Mass Spectrometer" in the name of Yasuhiro Mitsui et al discloses introducing a suitable gas into the first differential pumping region between the sampling and skimmer cones of an ICP-MS to promote charge transfer reactions. However it teaches repulsion of electrons from the plasma prior to the charge transfer reaction region, for example by use of a negatively charged mesh grid immediately behind the sampling cone orifice. Thus it teaches the introduction of a reactive gas into a region through which what is effectively an ion beam extracted from the plasma passes. U.S. Pat. No. 6,259,091 entitled "Apparatus for Reduction of Selected Ion Intensities in Confined Ion Beams" by Gregory C Eiden et al discloses introducing a reactive gas almost immediately behind the skimmer cone orifice. As in U.S. Pat. No. 4,948,962, this is in the region of an extracted ion beam and this beam must collide with the introduced gas molecules to undergo the necessary reactions. A dilemma with this is that the analyte signal intensity is reduced by collisions, thus maximum analyte sensitivity requires minimum collisions, but efficient attenuation of interferences requires maximum collisions. This dilemma unavoidably comprises the efficiency of these prior methods. U.S. Pat. No. 6,259,091 also discloses use of a reaction cell containing the reactive gas, namely hydrogen.

The reactive gas in this cell is maintained at an optimal pressure, but the cell is located wholly within a vacuum region at a different pressure, which complicates operation of this arrangement.

The discussion herein of the background to the invention is included to explain the context of the invention. This is not to be taken as an admission that any of the material referred to was published, known or part of the common general knowledge in Australia as at the priority date established by the present application.

An object of the present invention is to provide a plasma mass spectrometry instrument and method for elemental and isotopic analysis in which the attenuation of interfering polyatomic and multicharged ions is improved.

DISCLOSURE OF THE INVENTION

According to a first aspect, the present invention provides a mass spectrometer including

- a plasma ion source for providing analyte ions,
- a mass analyser,
- an interface between the plasma ion source and the mass analyser,
  - the interface comprising a structure which separates a first region at a relatively high pressure which receives plasma from the plasma ion source from a second region at a relatively low pressure leading to the mass analyser and which provides an aperture between the first higher pressure region and the second lower pressure region through which the plasma flows from the higher pressure region towards the lower pressure region,
  - the interface structure including a passage for supplying a substance into the aperture for interaction with the plasma for attenuating polyatomic or multicharged interfering ions by reactive or collisional interactions.

The invention, in a second aspect, provides a method for plasma mass spectrometry including generating a plasma containing analyte ions, substantially confining the plasma radially whilst flowing it from a higher pressure region towards a lower pressure region, supplying a substance directly into the substantially radially confined plasma to cause reactive or collisional interactions with polyatomic or multicharged interfering ions therein and thereby attenuate such polyatomic or multicharged ions, and extracting an ion beam from the plasma for mass analysis of the analyte ions.

In the case of an ICP-MS having a sampling cone-skimmer cone interface, the aperture of a mass spectrometer according to the first aspect of the invention may be the hole through either the sampling cone or the skimmer cone. Such a hole will radially confine the plasma as defined in the second (method) aspect of the invention. In this example, the sampling or skimmer cone may be specially constructed to include one or more passages having an outlet or outlets at the hole for supplying the substance for interaction with the plasma as it passes through the hole.

Thus, the invention in a third aspect provides a sampling cone or a skimmer cone for use in a plasma ion source mass spectrometer such as in the first aspect of the invention.

The substance for supply into the plasma passing through the aperture can be any one or a mixture of those which are known and have previously been used for attenuating interfering polyatomic or multicharged ions by reactive and collisional phenomena. Generally the substance or a mixture of substances may be chosen to remove selectively particular interferences, as is known. Hereinafter such a substance is termed a "reaction/collision substance".

The substance(s) may be a gas (for example nitrogen, hydrogen, oxygen, xenon, methane, propane, ammonia, helium). The present invention and examples of its use will be described and illustrated using hydrogen gas as a reactive/collision substance. It is to be understood, however, that any physical form of any substance(s) capable of delivering the desired interference attenuation effect may be introduced into the plasma in the manner disclosed by the present invention. The present invention involves appropriate reaction/collision substance(s) being introduced into the plasma as the plasma is passing through an aperture between two vacuum regions in a mass spectrometer so that the reaction/collision substance(s) can interact with plasma thereby reducing the concentration of interfering ions in the plasma. The applicant can show that electrons can interact with a plasma in a mass spectrometer to reduce the concentration of interfering ions in the plasma; accordingly, introduction of electrons into a plasma passing through an aperture between two vacuum regions in a mass spectrometer falls within the scope of the present invention. Thus the term "reaction/collision substance" is to be understood as encompassing such electrons.

The supply of a reaction/collision substance into the aperture which is substantially filled with the plasma as it flows through the aperture promotes occurrence of the attenuation reactions or collisions within the aperture where the plasma density is relatively high, which increases the rate of reaction or collision between the introduced substance and interfering ions. Indeed the reaction/collision substance is supplied effectively where the reactions or collisions occur at the fastest rate. Also, the reaction/collision substance is supplied into the plasma as such and not into an ion beam that has been extracted from the plasma, as in the prior art. This means that the plasma electrons are available to assist in attenuating the interfering ions through electron-ion dissociative recombination. The presence of plasma electrons also significantly reduces the generation of secondary products from the interference attenuating reactions, for example, for hydrogen added to an argon plasma there is very little (if any) increase in the numbers of $ArH^+$ or $H_3^+$ ions.

Another factor assisting the improved analytical performance achievable by the invention is that the reactions or collisions occur substantially within (that is, within or in close proximity to) a confined region inside an aperture across which a pressure differential exists. This pressure differential across a confined region and the associated plasma flow effectively "sweeps" the reaction and collision products including analyte ions out of that region and into the adjoining lower pressure region thereby increasing the availability of analyte ions in that lower pressure region. It is believed that a "collisional focussing" effect occurs in that analyte ions are pushed towards the centre of the plasma stream by the introduction of the reaction/collision substance, especially by radial introduction of the substance so that it flows towards the centre. Such introduction of the reaction/collision substance is capable of increasing the signals of light elements such as Be and Mg while interferences are effectively attenuated. These factors and others described below allow for increased attenuation of interfering polyatomic or multicharged ions and thus improved analytical performance, as may be demonstrated by analytical figures of merit such as detection limit, signal-to-background ratio and background equivalent concentration for a mass spectrometer according to the invention.

A mass spectrometer according to the invention may include an interface structure which provides a second aperture between the second relatively low pressure region and a third region at a pressure that is lower than that of the second region through which plasma flows after it flows through the second relatively low pressure region, the interface structure also including a second passage for supplying a substance into the second aperture for interaction with the plasma for attenuating polyatomic or multicharged interfering ions by reactive or collisional interactions. For example, for an ICP-MS, the sampling cone and the skimmer cone may provide sequential apertures into which the reaction/collision substances are supplied.

The option of a second aperture for the introduction of reaction/collision substance according to the invention allows for the same reaction/collision substance to be supplied to both apertures to increase the efficiency of the interference attenuation. It also allows for different reaction/collision substances to be supplied to the apertures making it possible to attenuate one type of interfering ion at one aperture and another type of interfering ion (including possibly products of reactions at the first aperture) at the second aperture. Using an appropriate combination of reactive/collision substances, it is believed that attenuation of a greater variety of interfering ions is possible with greater attenuation efficiency.

The interface structure of a mass spectrometer according to the invention may also include means for producing a shock wave in the region of the aperture or apertures where the reactions/collisions occur to promote the rate of reactions/collisions that remove interfering ions. Preferably, in the second (method) aspect of the invention, the substance is supplied into the substantially radially confined plasma in such a manner as to create a shock wave in the plasma. This increases the total energy available at the aperture or apertures and thus promotes more collisions having greater impact energy. This gives a further increase in the efficiency of attenuation of interfering ions.

Alternatively the reaction/collision substance may be supplied sufficiently smoothly as to cause substantial stagnation of the plasma without inducing a shock wave. The purpose of this is to increase the residence time of the plasma within and closely proximate to the aperture or apertures and thus possibly increase the efficiency of attenuation of interfering ions.

Other possibilities associated with supplying the reaction/collision substance for improving the attenuation efficiency include giving it sufficient speed to reach almost instantly the entire volume of plasma passing through an aperture, varying the angle of introduction of the substance, for example, for it to have a minimal radial speed component and an axial speed component matched to that of the passing plasma.

Although the above possibilities for supplying the reaction/collision substance are described as optional steps for the second (method) aspect of the invention, they may be realised by appropriate apparatus modifications in relation to the first (apparatus) aspect of the invention.

An additional advantage of the invention is that the interface structure will be heated by the plasma ion source and thus the reaction/collision substance supplied through the passage of the interface structure will also be heated. This heating of the reaction/collision substance may enhance the rate of reaction and consequently reduce the amount of the substance that is required.

Alternatively, the reaction/collision substance supplied through the passage of the interface structure can be used to cool that structure. This can reduce the efficiency of temperature induced sputtering of the surface of the interface structure. Material sputtered from the surface of the interface can contribute to the background, so any reduction in its rate of formation may improve the signal-to-background ratio.

For a better understanding of the invention and to show how the same may be carried into effect, various embodiments thereof will now be described, by way of non-limiting example only, with reference to the accompanying drawings.

DESCRIPTION OF PREFERRED EMBODIMENTS

Figure 1:
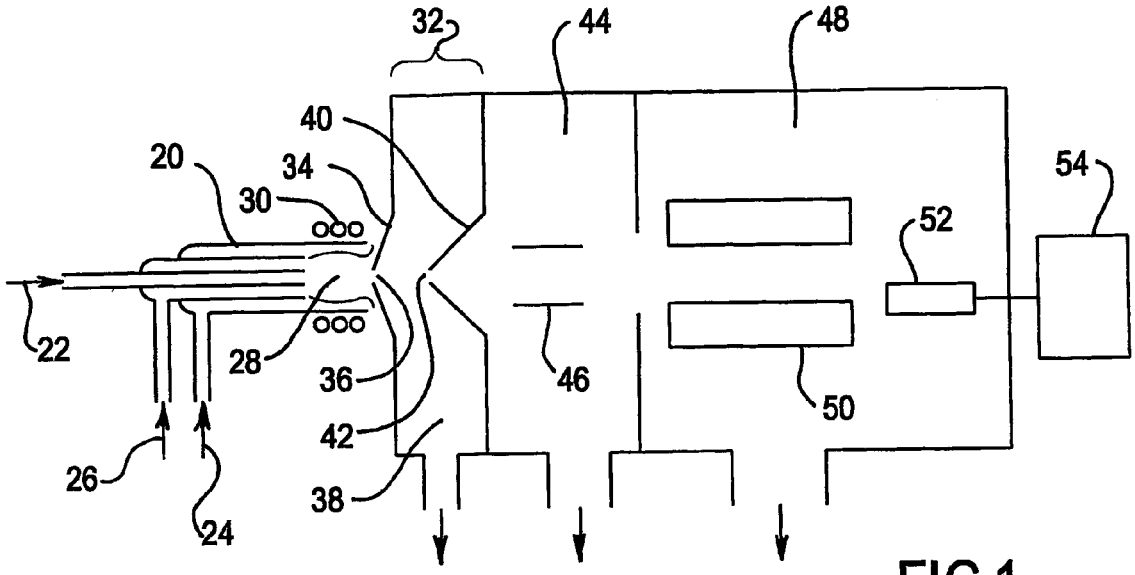
FIG 1 (PRIOR ART)
FIG. 1 schematically illustrates a conventional inductively coupled plasma ion mass spectrometer (ICP-MS).

The invention will be exemplified by an ICP-MS, however it is to be understood that the invention also relates to a mass spectrometer having a plasma ion source in which the plasma may be generated other than by radio frequency inductive coupling.

Throughout the figures, the same reference numeral is used to denote the same feature in the different embodiments.

A conventional ICP-MS (see FIG. 1) includes a plasma ion source 20, namely an inductively coupled plasma torch having a central tube for conveying nebulised sample 22 (analyte) in a carrier gas into a plasma 28 produced in the torch. The torch 20 includes an outer tube and an intermediate tube for conveying, respectively, a plasma forming gas 24 (for example, argon) and an auxiliary gas 26 (for example, argon). Plasma 28 is produced within the outer tube and beyond the outlets of the inner and intermediate tubes by a radio frequency coil 30 around the outer tube of the torch 20, and this plasma ionises the analyte 22, as is known.

The mass spectrometer includes an interface structure 32 via which plasma 28 including analyte ions is introduced into the mass analysing part of the spectrometer. The interface structure 32 includes a sampling cone 34 having a hole 36 (typically approximately 1 mm in diameter) at its apex through which some plasma 28 at atmospheric pressure passes into a first pumped vacuum region 38 (typically at a pressure of 1-10 torr). The interface structure 32 further includes a skimmer cone 40 having a hole 42 (typically approximately 0.5 mm in diameter) at its apex through which some plasma 28 passes from the first vacuum region 38 into a second pumped vacuum region 44 (typically at a pressure of $10^{-3}$-$10^{-4}$ torr). The sampling and skimmer cones 34, 40 are typically water-cooled. Second vacuum region 44 includes an ion extraction electrode 46 plus other ion optics (not shown) for extracting an ion beam from the plasma 28 passing through hole 42 of skimmer cone 40 and directing it into a third pumped vacuum region 48 (typically at a pressure of $10^{-5}$-$10^{-6}$ torr) and into a mass analyser 50 (for example, a quadrupole mass analyser) in region 48. Mass analyser 50 separates the ions according to their mass to charge ratio and those that pass through the mass analyser 50 are detected by a detector 52 (for example, an electron multiplier) and read out by recording means 54.

Figure 2:
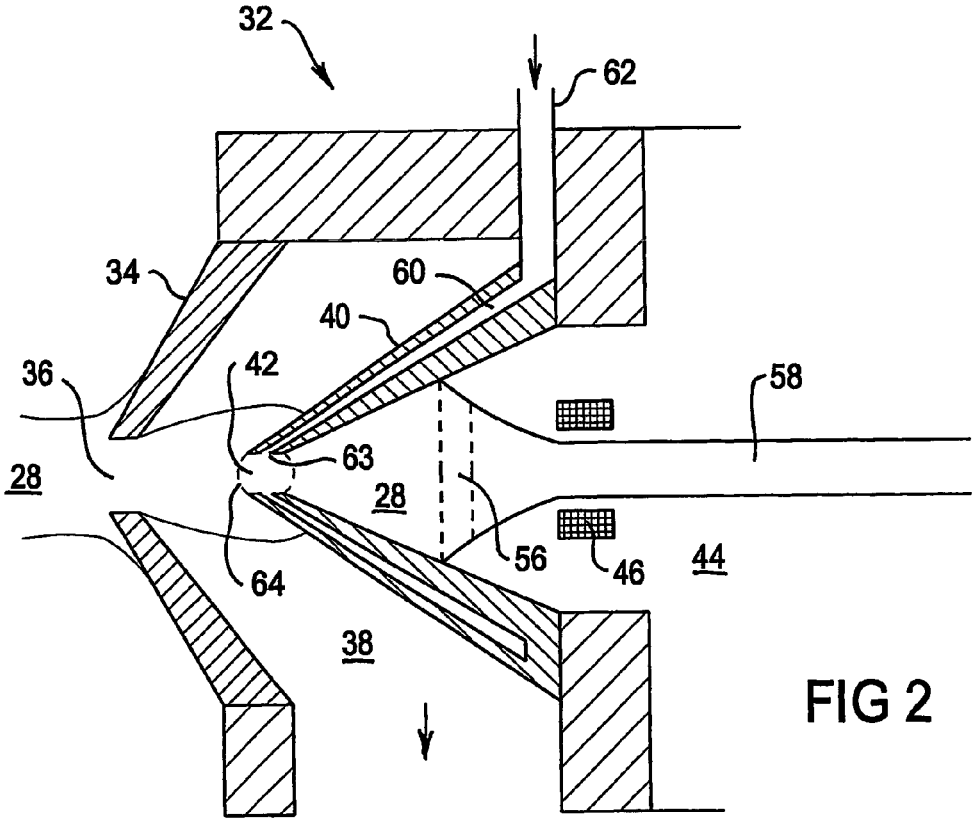
FIG. 2 schematically illustrates an interface structure for a mass spectrometer as in FIG. 1 for a first embodiment according to the first aspect of the invention wherein a reaction/collision region is established at the skimmer cone hole or aperture.

FIG. 2 illustrates a portion of a mass spectrometer as in FIG. 1 that incorporates an embodiment of the invention. It illustrates an interface structure 32 that includes a sampling cone 34 having a hole 36 and a skimmer cone 40 having a hole 42 with the first vacuum region 38 therebetween (typically at a pressure in the range 1-10 torr). The skimmer cone 40 leads to the second vacuum region 44 (typically at a pressure of $10^{-3}$-$10^{-4}$ torr) which includes an ion extraction electrode 46. Plasma 28 flows through hole 36 in sampling cone 34 into lower pressure region 38 and then through hole 42 in skimmer cone 40 into still lower pressure region 44. The electrode 46 produces an electrostatic field that extracts ions from a plasma boundary region 56, including repelling electrons from that boundary region, of the plasma 28 in vacuum region 44 to form an ion beam 58. Skimmer cone 40 includes a passage 60 leading from an inlet 62 to an outlet 63 at the hole 42 of the skimmer cone 40 (which constitutes an aperture as in the first aspect of the invention). This is for supplying a reaction/collision substance into the hole 42 for interaction with the plasma 28 passing therethrough for attenuating polyatomic or multicharged interfering ions by reactive (charge transfer) or collisional reactions.

In the embodiment of FIG. 2 of the invention, the plasma 28 flows from the low pressure region 38 towards the lower pressure region 44 through the hole 42 passing through the skimmer cone 40 and substantially fills the hole 42. Thus the reaction/collision substance is supplied effectively directly into the plasma 28 in hole 42 via inlet 62, passage 60 and outlet 63. The attenuating reactions/collisions thus occur within or in close proximity to the hole 42 as represented by the outlined region 64, which can be called the reaction zone. The dimensions of the reaction zone or region 64 depend on a number of factors such as plasma density, temperature, kind of reaction/collision substance, speed of the reaction and plasma velocity. It is postulated that significant interference attenuation in the reaction region 64 can take as little as 1-10 ns. This means that the reaction has effectively already occurred when the plasma has travelled about 0.001-0.01 mm through the hole 42. Conversely if the reaction time were in the range 100-1000 ns the reaction zone might be project out of the aperture by one or more mm. This means that the shape of the reaction zone 64 shown in FIG. 2 is purely schematic and it might be very different in shape and dimensions in reality. A major difference between region 64 and the reaction/collision zones in prior art collision cells is the absence of a physical substantially surrounding boundary to region 64. Another significant difference is that the reactions/collisions occur in the plasma instead of in an ion beam extracted from it.

Figure 3:
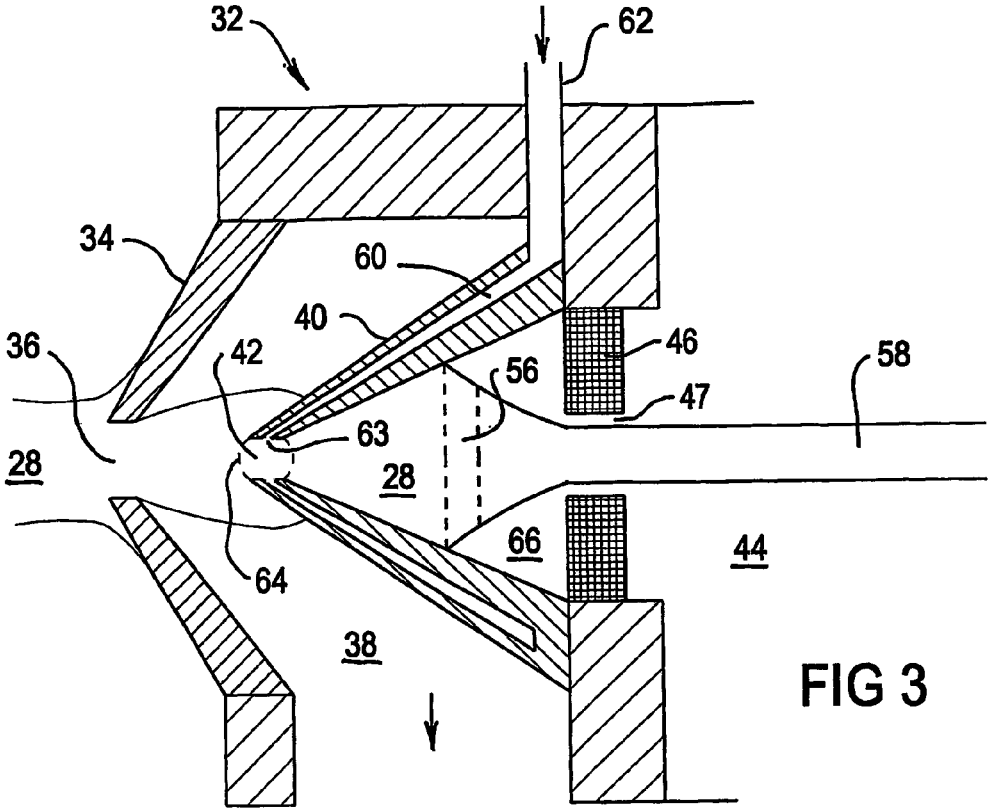
FIG. 3 schematically shows another interface structure for a mass spectrometer as in FIG. 1 for a second embodiment according to the first aspect of the invention wherein a reaction/collision region at the skimmer cone hole is followed by a collision zone.

FIG. 3 illustrates a portion of a mass spectrometer as in FIG. 1 that combines the embodiment of FIG. 2 with a modification to create a restricted pumping zone behind the skimmer cone 40. In this FIG. 3 embodiment of the invention, a restricted pumping region 66 is provided behind the skimmer cone 40 by way of the ion extraction electrode 46 being mounted immediately behind the skimmer cone 40 (alternatively the ion extraction electrode 46 may be mounted to the inner wall of the skimmer cone 40 by a dielectric seal—not shown). The ion extraction electrode 46 effectively acts as a gas baffle to restrict pumping from the portion 66 of the relatively low pressure region 44 encompassed between the skimmer cone 40 and the ion extraction electrode 46. Additional ion optics (not shown) in region 44 may assist ion extraction electrode 46 (which repels electrons from plasma boundary region 56) in forming a focussed ion beam 58.

In the embodiment of FIG. 3, the region 66, because of the restricted pumping therefrom via the orifice 47 through ion extraction electrode 46 (which is typically 1-7 mm in diameter) will have a pressure therein between that in vacuum region 38 and vacuum region 44. This pressure is typically in the range 0.1-1 torr. The pressure in region 66 is set by the ratio of the area of the entrance aperture 42 to that of the exit aperture 47, and the rate at which gas is pumped from vacuum region 38. Region 66 has an entrance aperture (that is, the opening cross-sectional area of hole 42 through skimmer cone 40) through which the plasma 28 flows from the higher pressure region 38 towards the lower pressure region 44 and substantially fills the volume 66.

A reaction/collision substance is supplied to the hole 42 through skimmer cone 40 via inlet 62, passage 60 and outlet 63 (as in the FIG. 2 embodiment). This establishes a single reaction zone 64 as in the FIG. 2 embodiment which is followed by a pressurised volume 66 wherein ion beam 58 is extracted from plasma boundary 56 in the presence of multiple collisions. The collisions may occur because of the relatively higher pressure therein compared to vacuum region 44. The collisions may assist in producing a significant sensitivity increase by forming a thermalised, better focused ion beam 58.

Figure 4:
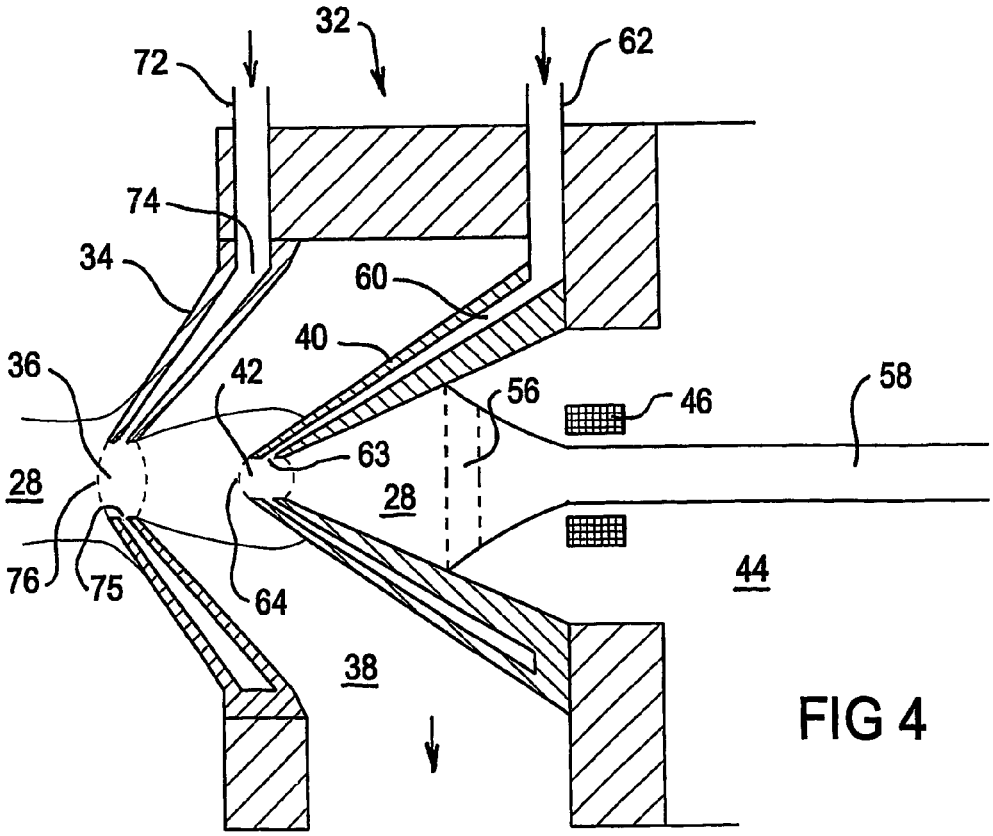
FIG. 4 schematically shows another interface structure for a mass spectrometer as in FIG. 1 for a third embodiment according to the first aspect of the invention that provides two sequential reaction/collision regions.

FIG. 4 illustrates a portion of a mass spectrometer as in FIG. 1 that incorporates another embodiment of the invention. This embodiment is similar to that of FIG. 2 except that the sampling cone 34 includes an inlet 72, passage 74 and outlet 75 for supplying a reaction/collision substance into the hole 36 through the sampling cone 34, thereby establishing a reaction zone 76 within and in close proximity to the hole 36. Thus two sequential reaction zones 76 and 64 are established to enhance the efficiency of attenuation of interfering ions. This embodiment also allows the use of two different reaction/collision substances to achieve attenuation of a wider range of interfering ions. The depicted shapes and dimensions of the reaction zones 76 and 64 are purely schematic and may vary significantly depending on a number factors affecting the reaction conditions.

Figure 5:
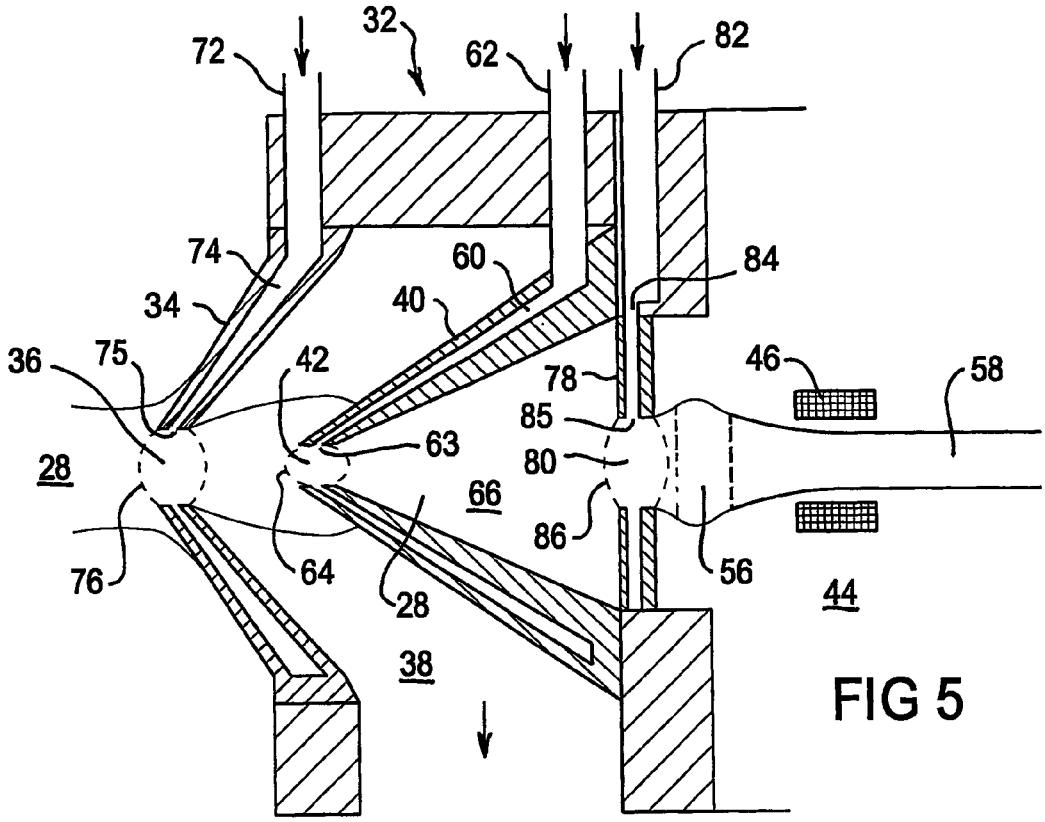
FIG. 5 schematically shows another interface structure for a mass spectrometer as in FIG. 1 for a fourth embodiment according to the first aspect of the invention that provides three sequential reaction/collision regions.

FIG. 5 illustrates a portion of a mass spectrometer as in FIG. 1 that incorporates another embodiment of the invention. This embodiment is similar to that of FIG. 4 in that the two sequential reaction zones 76 and 64 respectively are established at the sampling cone 34 and skimmer cone 40. This embodiment includes an electrode 78 having a hole 80 therethrough which acts as a gas baffle in conjunction with the downstream side of skimmer cone 40 to establish a region 66 of relatively higher pressure compared to region 44 (as in the FIG. 3 embodiment). Typically hole 80 may be 1-7 mm in diameter and the pressure in volume 66 in the range 1-0.01 torr. An electric potential may advantageously be applied to electrode 78 to assist ion extraction through hole 80. Electrode 78 includes a passage 84 leading from an inlet 82 to an outlet 85 for supplying a reaction/collision substance into the hole 80 to create another reaction zone 86. Thus in this embodiment three sequential reaction zones, 76, 64, 86 are created. This will increase the total time available for reaction and provides enhanced attenuation of interfering ions. Also, similarly to the FIG. 4 embodiment, this embodiment allows the use of up to three reaction/collision substances to achieve attenuation of a wider range of interfering ions.

Figure 6:
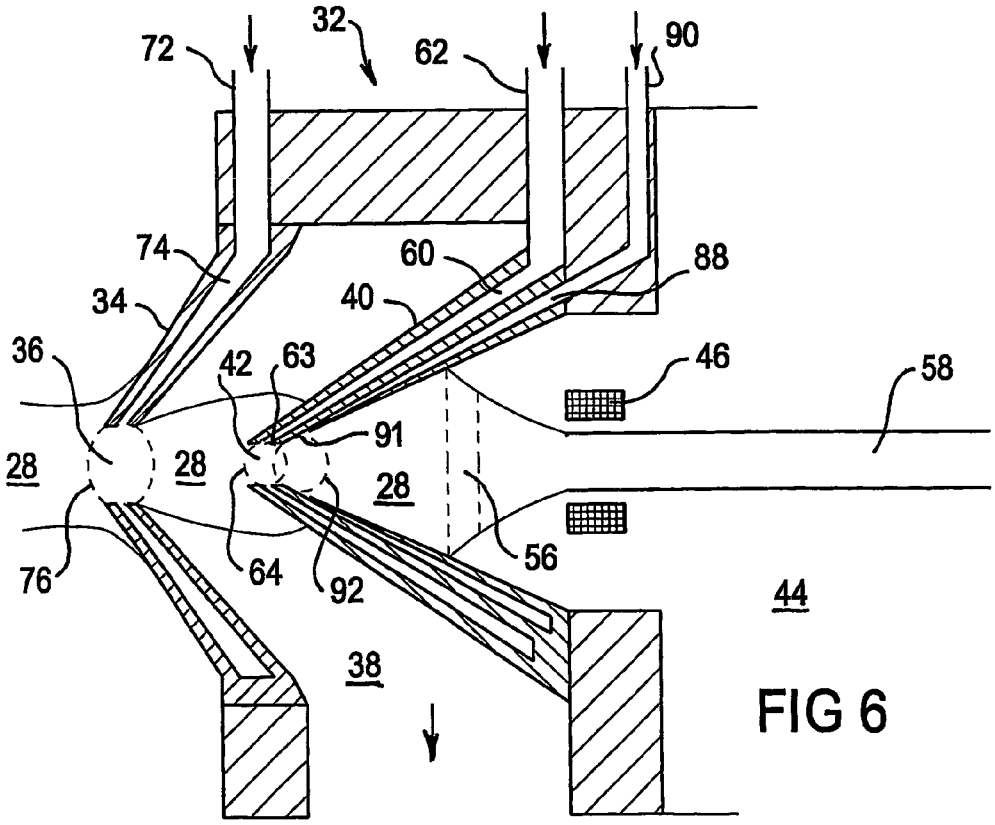
FIG. 6 schematically shows another interface structure for a mass spectrometer as in FIG. 1 for a fifth embodiment according to the first aspect of the invention that provides two reaction/collision regions at the skimmer cone.

FIG. 6 illustrates a portion of a mass spectrometer as in FIG. 1 that incorporates another embodiment of the invention. In this embodiment the skimmer cone 40 in addition to the passage 60, includes a second passage 88 leading from an inlet 90 to an outlet 91 for supplying a reaction/collision substance into the hole 42 of skimmer cone 40. This creates a second reaction zone 92 within and closely proximate the hole 42 which may possibly overlap with the reaction zone 64. In this embodiment, attenuation of interfering ions occurs within and closely proximate the hole 36 in sampling cone 34 and hole 42 in skimmer cone 40, but a combination of two reaction zones 64, 92 in one hole 42 leads to a greater efficiency of interference attenuation. It is also possible to use two or more different reaction/collision substances in overlapping reaction zones 64 and 92 to achieve better attenuation of a wider range of interfering ions.

Figure 7A:
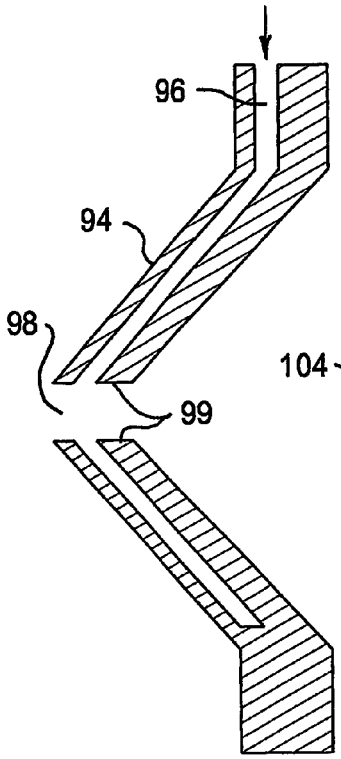
FIGS. 7A to C are schematic sectional views of sampling or skimmer cones for use in interface structures as in FIGS. 2 to 6 illustrating different hole configurations.
Figure 7B:
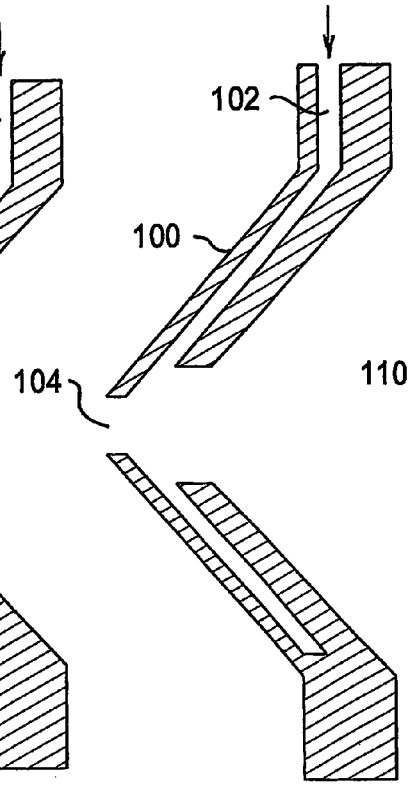
Figure 7C:
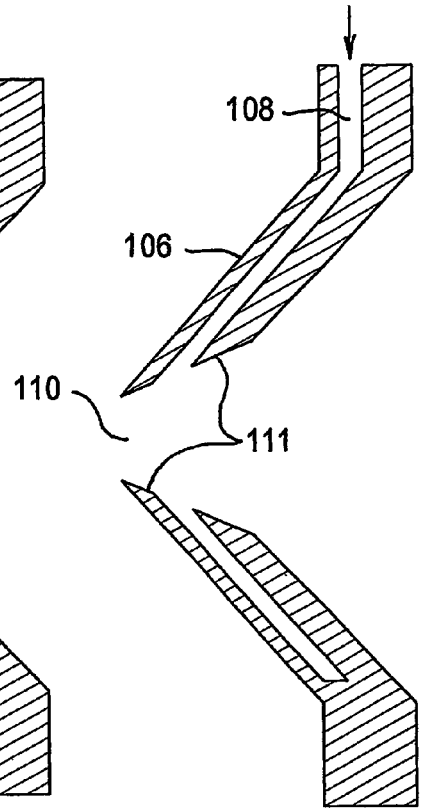

FIGS. 7A-C are sectional views of sampling or skimmer cones for use in an interface structure 32 in embodiments of the invention illustrating different configurations for their holes. In FIG. 7A, cone 94 includes a passage or duct 96 for supply of a reaction/collision substance into its hole 98 which has a conventional parallel-walled neck 99, but which is significantly long to promote extra collisions. In FIG. 7B, cone 100 includes a passage 102 for supplying a reaction/collision substance into its hole 104. The diameter of hole 104 increases stepwise. This provides less restriction to expansion of the plasma as it passes through the hole 104. This makes the hole 104 less susceptible to clogging by solids deposited from the plasma. In FIG. 7C, cone 106 includes a passage 108 for supplying a reaction/collision substance into its hole 110 which is of tapered form 111 to minimally restrict expansion of the plasma as it passes therethrough. Although this form of hole 110 compromises the efficiency of the cone 106, it has the advantage of being even less susceptible to clogging by solids deposited from the plasma compared to hole 104 of cone 100.

Figure 8A:
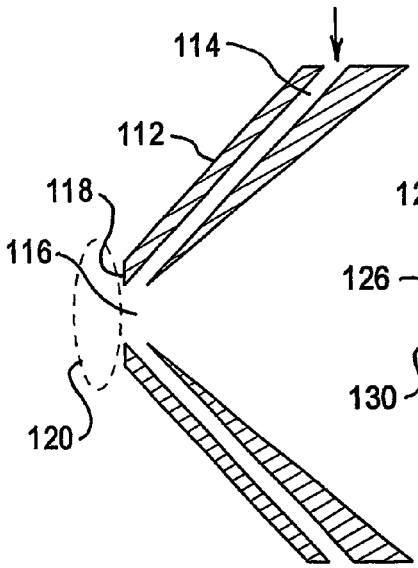
FIGS. 8A to C are schematic sectional views of sampling or skimmer cones for use in interface structures as in FIGS. 2 to 6 for inducing shock waves or matching the flow of a supplied substance with the plasma flow.
Figure 8B:
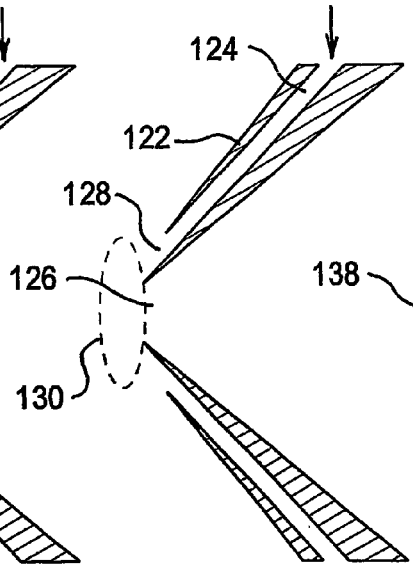
Figure 8C:
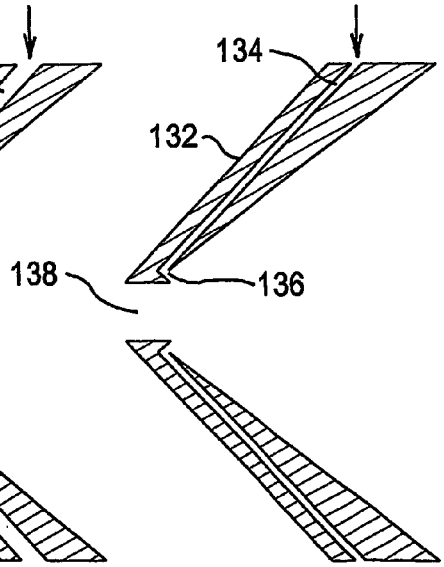

FIGS. 8A-C are sectional views of additional sampling or skimmer cones for use as part of an interface structure 32 in embodiments of the invention. In FIG. 8A, cone 112 has a passage 114 leading to hole 116. The leading surface 118 of cone 112 around its hole 116 is flat, or blunt, for forming a detached shock wave 120 just in front of the reaction zone of the hole 116. The sequence of the shock wave zone 120 and following reaction zone of hole 116 is capable of producing greater attenuation of interferences than a reaction zone of hole 116 alone. In FIG. 8B, cone 122 has a passage 124 leading to hole 126. Passage 124 has outlet 128 located slightly outwardly of the entrance of hole 126 and, similarly to the blunt surface 118 of cone 112 of FIG. 8A, induces a detached shock wave 130. A reaction/collision substance supplied through passage 124 is introduced primarily into the shock wave zone 130 to cause reactions/collisions within this zone, which is favourable to the attenuation of interfering ions. In FIG. 8C, cone 132 has a passage 134 with an outlet 136 at hole 138 through the cone 132. The outlet 136 is configured such that a reaction/collision substance supplied through passage 134 exits the passage in a similar direction as the plasma flow through hole 138. This favours substantially matching the flow speed of the reaction/collision substance in the reaction zone of hole 138 with that of the plasma. This lessens disturbance of the plasma flow and therefore allows better control of the reactions occurring therein.

Figures 9A, 9B, 9C, 9D, 9E:
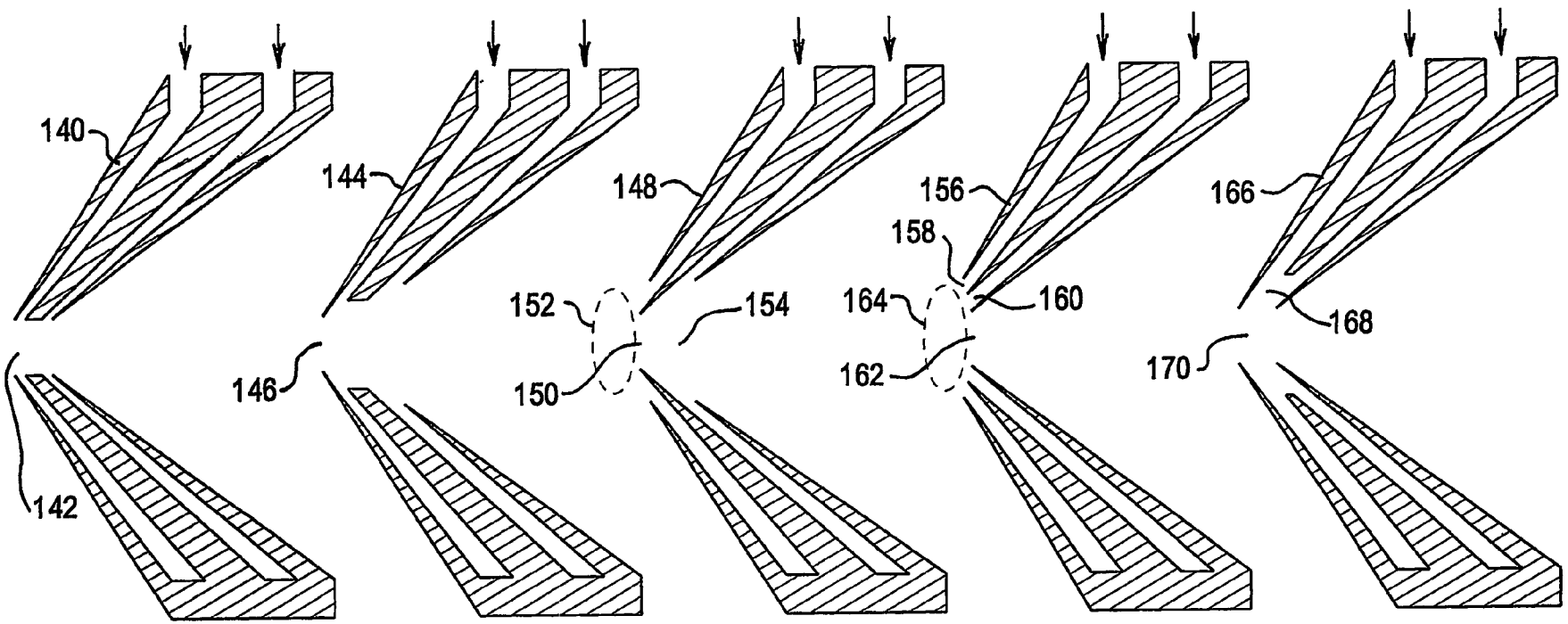
FIGS. 9A to E are schematic sectional views of sampling or skimmer cones for use in interface structures as in FIGS. 2 to 6 for possibly supplying two reaction/collision substances to a reaction/collision region.

FIGS. 9A-E are sectional views of additional sampling or skimmer cones for use as part of an interface structure 32 in embodiments of the invention. All the cones of FIGS. 9A-E include two passages leading to their holes to establish at least two separate or overlapping reaction zones at those holes. In FIG. 9A, cone 140 has a generally parallel walled hole 142 (similar to that of FIG. 7A) within or in close proximity to which complex shock waves (not shown) can be created by the supply of the reaction/collision substances into the hole 142 to promote improved attenuation of interfering ions. In FIG. 9B, cone 144 has a hole 146 of increasing diameter step-wise (similar to that of FIG. 7B). This allows some expansion of the plasma as it flows through hole 146 which can provide higher transport of analyte ions and achieve increased signal-to-background ratios. In FIG. 9C, cone 148 has a hole 150 similar to that of FIG. 8B combined with FIG. 7C. Thus a detached shock wave 152 is formed in front of the hole 150. This cone 148 provides a sequence of two reaction zones with the first such zone located in the region of detached shock wave 152 and the second in a region 154 of low plasma disturbance. In FIG. 9D, cone 156 has passage outlets 158, 160 at hole 162 configured to establish a detached shock wave 164 at the reaction zone of the hole 162 to improve attenuation of interfering ions. In FIG. 9E, cone 166 has passage outlets providing a zone 168 for two reaction/collision substances supplied through the passages to mix together immediately prior to introduction of the mixture into a plasma flowing through hole 170.

Figure 10:
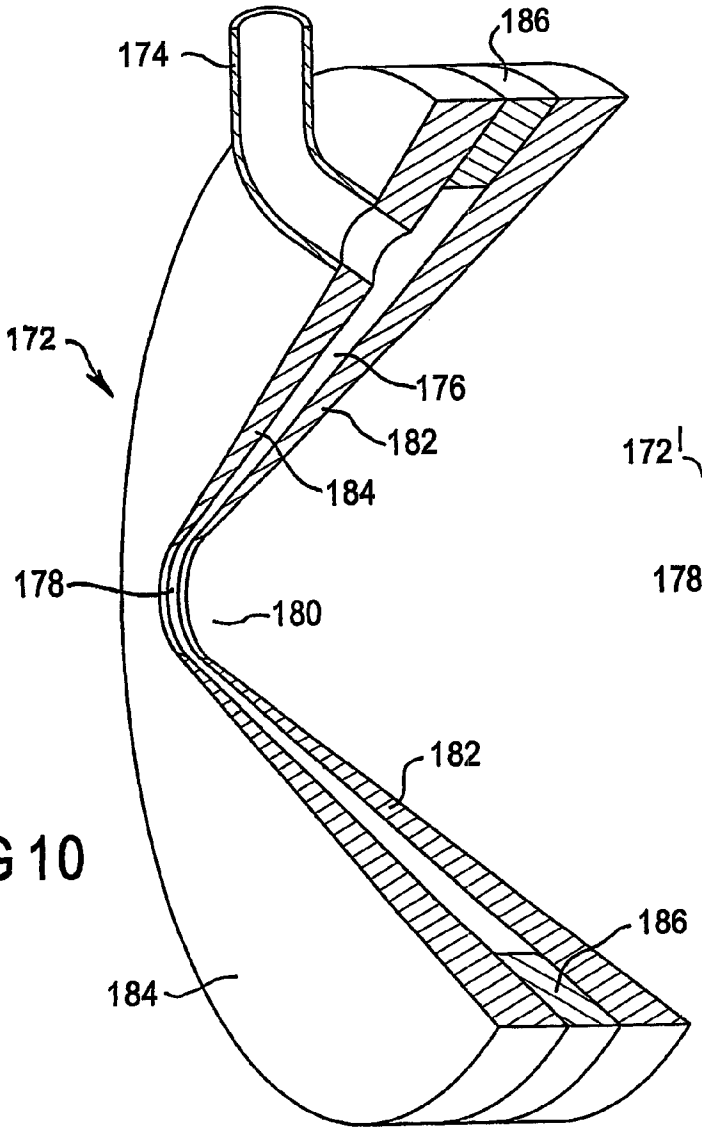
FIG. 10 is a schematic three-dimensional view of a sampler or skimmer cone for an ICP-MS embodiment of the invention with a sector cut away to illustrate its internal structure.

FIG. 10 is a three-dimensional view of a sampling or skimmer cone 172 for an ICP-MS embodiment of the invention with a sector cut away to illustrate its internal structure. Cone 172 includes a passage 176 having an inlet 174 and an outlet 178 at the hole 180 of the cone. A reaction/collision substance is supplied into a reaction zone at hole 180 via inlet 174, passage 176 and outlet 178. Cone 172 may be assembled from two conical parts 182, 184 joined together around the outer periphery with an annular plate 186 sandwiched therebetween. The distance between parts 182 and 184 at outlet 178 can be small. The intent is not to create an aperture having a parallel neck, but only to provide a passage through which to introduce the collision/reaction substance into the reaction zone.

Figure 11:
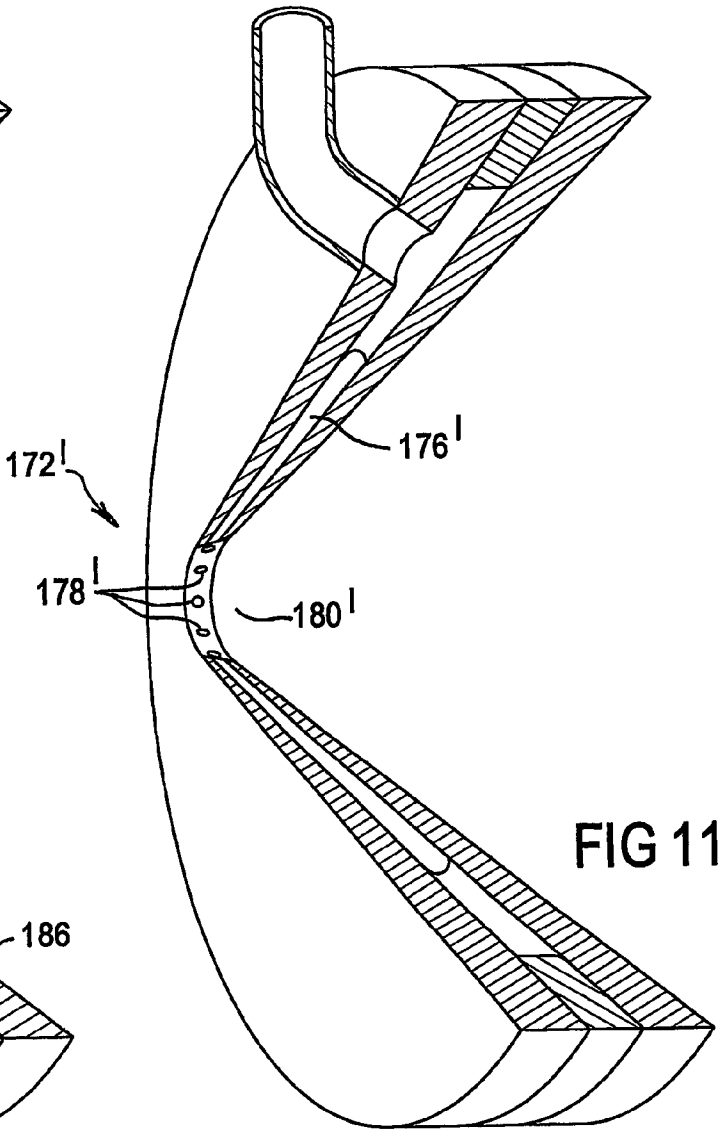
FIG. 11 is a view similar to FIG. 10 but showing a modification.

FIG. 11 illustrates a cone 172' which is a modification of the cone 172 of FIG. 10. The modification is that the passage 176' has a series of separate outlets 178' at the hole 180'. The purpose of this arrangement of separate outlets 178' from passage 176' is to impart a desired radial speed to the reaction/collision substance as it enters the hole 180' so as to reduce mixing time in the reaction zone of hole 180' and provide more efficient attenuation of interfering ions and/or less consumption of the reaction/collision substance.

Outlets such as 178 or 178' for the passages 176 or 176' in sampling or skimmer cones such as 172 or 172' have the advantage that the reaction/collision substance is introduced substantially symmetrically around the plasma as it flows through a hole 180 or 180' and will thus have a substantially uniform influence on the plasma. In contrast, when a reactive gas is introduced from one side as in the prior art in U.S. Pat. No. 6,259,091, it will have a non-uniform effect. That is, assuming that interfering ions are distributed uniformly across the ion beam, the non-uniform introduction of the reactive gas means that interfering ions in different parts of the ion beam will be exposed to different concentrations of the reactive gas and consequently will undergo reaction with that gas at different rates, and thus lower the efficiency of interference attenuation.

Figure 12A:
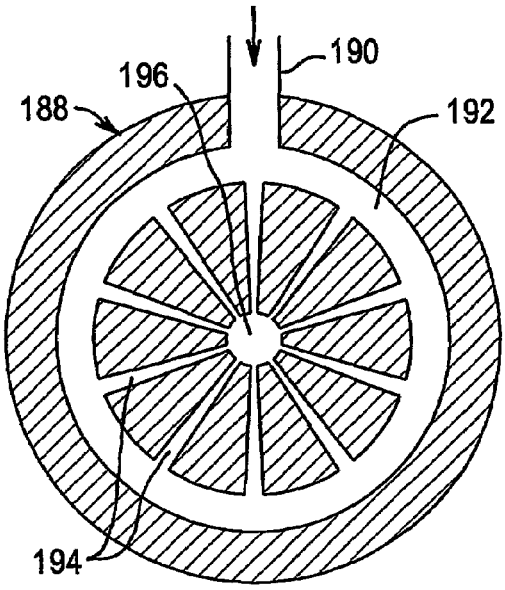
FIGS. 12A to D are cross-sections of sampling or skimmer cones for an ICP-MS embodiment of the invention showing passage configurations for supplying reaction/collision substances.
Figure 12B:
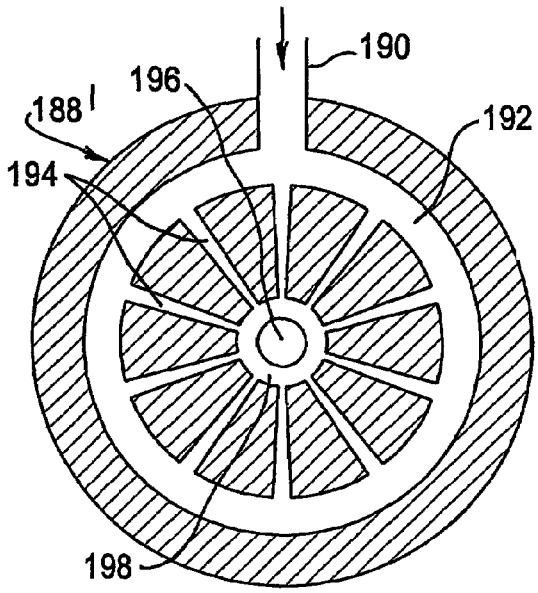
Figure 12C:
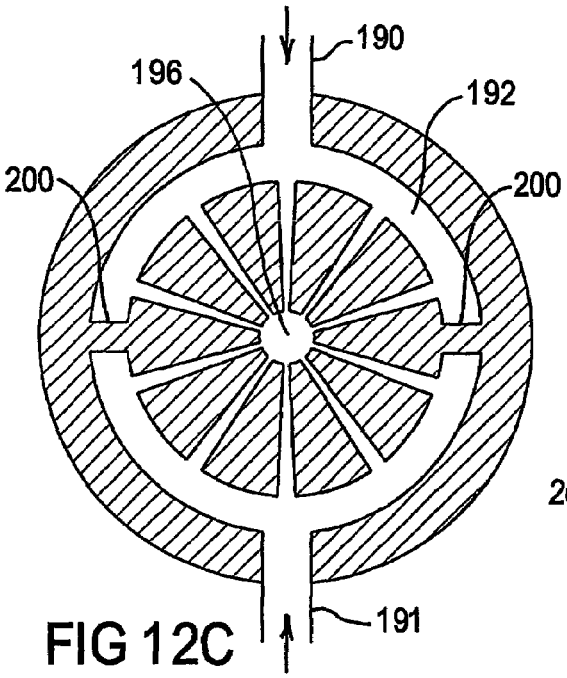
Figure 12D:
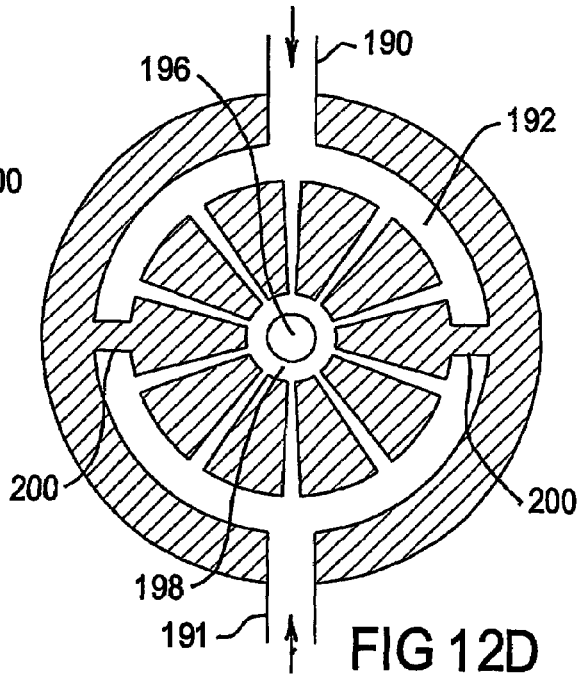

FIGS. 12A-D are cross-sections of sampling or skimmer cones for an ICP-MS embodiment of the invention, the cross-sections being taken through passages for supply of the reaction/collision substance to illustrate configurations therefor. Thus cone 188 of FIG. 12A has an inlet 190 for the reaction/collision substance which leads to a circumferential passage 192 from which radial ducts or passages 194 lead to outlets at hole 196. Cone 188' of FIG. 12B similarly includes an inlet 190, circumferential passage 192 and radial ducts 194, however the outlets of ducts 194 are arranged to provide a mixing region 198 for the supplied reaction/collision substance next to the hole 196. The cones of FIGS. 12C and 12D are similar to those of FIGS. 12A and 12B respectively, except that each includes two inlets 190 and 191 for supplying separate reaction/collision substances, and circumferential passage 192 is divided into two by partitions 200, with each half of the passage 192 communicating with a respective inlet. These cones allow mixing of two or more reaction/collision substances effectively simultaneously with the plasma directly inside the reaction zone of hole 196. This avoids a risk of premature reaction between the substances instead of reacting with the interfering ions in the plasma passing through hole 196. A cone may be configured similarly to those of FIGS. 12C and D but which includes more than two inlets.

The present invention allows for a significant reduction in the amount of a reaction/collision gas that is introduced compared to previously known methods wherein a reaction/collision gas is introduced either directly into a vacuum region or indirectly via an ICP torch. This is because a substantial portion of the reaction/collision gas in such previously known methods is pumped away by the vacuum system without ever participating in the necessary reactions, whereas according to embodiments of the present invention a reaction/collision gas is introduced directly into the sampled plasma prior to the extraction of an ion beam therefrom. A reduction in the amount of a reaction/collision gas by up to a factor of 10 is possible according to embodiments of the invention.

EXPERIMENTAL TESTS

A conventional ICP-MS instrument was modified as shown by FIG. 4, with an ion extraction electrode 46 and additional ion optics for focussing the ion beam. The reaction/collision substance used for the experiments was hydrogen but it should be understood that in principle any substance or species capable of interacting with interfering ions may be used in accordance with the present invention.

Signals for many ions that are potential interferences in ICP-MS were monitored during the experiments. Special attention was given to $^{40}Ar^{+}$, $^{40}Ar^{12}C^{+}$, $^{40}Ar^{16}O^{+}$, $^{40}Ar^{16}O^{1}H^{+}$, $^{40}Ar^{35}Cl^{+}$, and $^{40}Ar^{40}Ar^{+}$. Significantly better attenuation than that reported [U.S. Pat. No. 6,259,091 col. 14, line 17] for prior art according to Table 1 was found for all these ions. The improvement in detection limits for $^{40}Ca$, $^{52}Cr$, $^{56}Fe$, $^{57}Fe$, $^{75}As$, and $^{80}Se$ over those reported for the prior art according to Table 2 (below) was also good. Most significantly, it was found that introduction of aqueous samples containing up to 5% (by volume) concentrated hydrochloric acid did not produce the increase in Cl-based interfering ions that would be expected with a conventional ICP-MS instrument. This means that the efficiency of the attenuation of interferences grows at the same rate as the concentration of potentially interfering species. This in turn means that reliable signals for analyte ions can be detected in the presence of parent elements of potentially interfering ions, irrespective of variable concentrations of those elements in the sample solutions.

Results for the attenuation of $^{40}Ar^{16}O^{+}$, $^{40}Ar^{35}Cl^{+}$, and $^{40}Ar^{40}Ar^{+}$ interferences by using hydrogen as a reactive gas are presented in Table 1.

TABLE 1

| Interference | Isotope subject to interference | Interference reduction by prior art (U.S. Pat. No. 6,259,091) | Interference reduction by the embodiment of FIG. 4 |
|---|---|---|---|
| $^{40}Ar^{16}O^{+}$ | $^{56}Fe$ | 2 | 2500 |
| $^{40}Ar^{16}O^{1}H^{+}$ | $^{57}Fe$ | not reported | 3000 |
| $^{40}Ar^{35}Cl^{+}$ | $^{75}As$ | not reported | 1000 |
| $^{40}Ar^{40}Ar^{+}$ | $^{80}Se$ | 5 | 20000 |

Table 2 shows the detection limits achieved using hydrogen as a reactive gas in comparison with a passive RF-only collision cell [*]. The lower the detection limit, the better.

TABLE 2

| Interference | Isotope subject to interference | Detection limits with collision cell [*], ng/litre | Detection limits with the embodiment of FIG. 4, ng/litre |
|---|---|---|---|
| $^{40}Ar^{+}$ | $^{40}Ca$ | — | 3.2 |
| $^{16}O^{35}Cl^{+}$ | $^{51}V$ | 24 | 4.8 |
| $^{40}Ar^{12}C^{+}$ | $^{52}Cr$ | 22 | 4.0 |
| $^{40}Ar^{16}O^{+}$ | $^{56}Fe$ | 960 | 0.9 |
| $^{40}Ar^{16}O^{1}H^{+}$ | $^{57}Fe$ | 2100 | 23 |
| $^{40}Ar^{35}Cl^{+}$ | $^{75}As$ | 570 | 30 |
| $^{78}ArCl^{+}$ | $^{78}Se$ | 610 | 38 |
| $^{40}Ar^{40}Ar^{+}$ | $^{80}Se$ | 130 | 55 |

Table 3 shows the background-equivalent concentration (BEC) achieved using hydrogen as a reactive gas, compared with a passive RF-only Collision Cell [*]. The lower the BEC, the better.

TABLE 3

| Interference | Isotope subject to interference | BEC with collision cell [*], ng/litre | BEC with the embodiment of FIG. 4, ng/litre |
|---|---|---|---|
| $^{40}Ar^{+}$ | $^{40}Ca$ | — | 40.4 |
| $^{16}O^{35}Cl^{+}$ | $^{51}V$ | 190 | 7.1 |
| $^{40}Ar^{12}C^{+}$ | $^{52}Cr$ | 180 | 14.4 |
| $^{40}Ar^{16}O^{+}$ | $^{56}Fe$ | 1600 | 14.1 |
| $^{40}Ar^{16}O^{1}H^{+}$ | $^{57}Fe$ | 19000 | 141 |
| $^{40}Ar^{35}Cl^{+}$ | $^{75}As$ | 360 | 38.5 |
| $^{78}ArCl^{+}$ | $^{78}Se$ | 5100 | 34.5 |
| $^{40}Ar^{40}Ar^{+}$ | $^{80}Se$ | 880 | 124.3 |

[*] Christopher P. Ingle, Petra K. Appelblad, Matthew A. Dexter, Helen J. Reid and Barry L. Sharp, 'The use of background ions and a multivariate approach to characterise and optimise the dominant H2-based chemistries in a hexapole collision cell used in ICP-MS', JOURNAL OF ANALYTICAL ATOMIC SPECTROMETRY, Vol. 16, (2001), pp. 1076-1084.

The invention described herein is susceptible to variations, modifications and/or additions other than those specifically described and it is to be understood that the invention includes all such variations, modifications and/or additions which fall within the scope of the following claims.

What is claimed is:

1. A mass spectrometer comprises:

a plasma ion source, which provides analyte ions;

a mass analyzer;

an interface between the plasma ion source and the mass analyzer; and the interface comprising an interface structure being one of a sampling cone and a skimmer cone of the interface, which separates a first region at a relatively high pressure adjacent a first surface of said structure, which receives plasma from the plasma ion source and providing separation from a second region at a relatively low pressure leading to the mass analyzer, said second region adjacent a second surface of said interface structure and, which provides an aperture having axial extension forming a reaction zone between the first surface and the second surface through which the plasma flows from the higher pressure region towards the lower pressure region through said axial extending aperture, the interface structure comprising a passage, which supplies a substance into the reaction zone aperture interacting with the plasma for attenuating polyatomic or multicharged interfering ions by reactive or collisional interactions;

wherein the passage is located completely within a cone and leads from an inlet to an outlet at said cone aperture.

2. The mass spectrometer as claimed in claim 1, wherein the interface comprises a sampling cone followed by a skimmer cone, wherein said structure is the skimmer cone, which includes the passage for supplying a substance into its aperture.

3. The mass spectrometer as claimed in claim 1, wherein the interface comprises a sampling cone followed by a skimmer cone, wherein said structure is the sampling cone, which includes the passage for supplying a substance into its aperture.

4. The mass spectrometer as claimed in claim 2, wherein the sampling cone includes a passage for supplying a substance into its aperture for interaction with the plasma for attenuating polyatomic or multicharged interfering ions by reactive or collisional interactions.

5. The mass spectrometer as claimed in claim 2, further comprising an electrode means following the skimmer cone, which extracts an ion beam containing analyte ions from the plasma for transmission to the mass analyser, the electrode means comprises at least one electrode, which is configured and associated with the skimmer cone such that the portion of the relatively low pressure region between the skimmer cone and the at least one electrode has a relatively higher pressure than the pressure elsewhere within said relatively low pressure region thereby to provide a collisional gas volume for assisting the attenuation of polyatomic or multicharged interfering ions.

6. The mass spectrometer as claimed in claim 5, wherein the at least one electrode includes a passage, which supplies a substance into an aperture of the at least one electrode for interaction with the plasma for attenuating polyatomic or multicharged interfering ions by reactive or collisional interactions.

7. The mass spectrometer as claimed in claim 2, wherein the skimmer cone includes an additional passage, which supplies an additional substance into its aperture for interaction with the plasma for attenuating polyatomic or multicharged interfering ions by reactive or collisional interactions.

8. The mass spectrometer as claimed in claim 4, wherein the sampling cone includes an additional passage, which supplies an additional substance into its aperture for interaction with the plasma for attenuating polyatomic or multicharged interfering ions by reactive or collisional interactions.

9. The mass spectrometer as claimed in claim 4, wherein the apertures through which the plasma flows and into which the substance for interaction with the plasma is supplied is parallel-walled and relatively long for promoting extra collisions.

10. The mass spectrometer as claimed in claim 4, wherein the apertures, through which the plasma flows and into which the substance for interaction with the plasma is supplied has a diameter, which increases stepwise in the direction of flow of the plasma for lessening clogging of the aperture by solids deposited from the plasma.

11. The mass spectrometer as claimed in claim 4, wherein the apertures, through which the plasma flows and into which the substance for interaction with the plasma is supplied is tapered outwardly in the direction of flow of the plasma for lessening clogging of the aperture by solids deposited from the plasma.

12. The mass spectrometer as claimed in claim 4, wherein the interface structure includes means producing a shock wave in the region of the apertures where the reactions or collisions occur to promote the rate of reactions or collisions that remove interfering ions.

13. The mass spectrometer as claimed in claim 2, wherein the passage, which supplies a substance into the aperture has an outlet, which is located and configured for inducing a shock wave in the region of the aperture to promote the rate of reactions or collisions improving the attenuation of interfering ions.

14. The mass spectrometer as claimed in claim 2, wherein the passage, which supplies a substance into the aperture has an outlet, which is located and configured for a substance supplied therethrough to exit the passage in substantially the same direction as the plasma flow through the aperture.

15. A method for plasma mass spectrometry in accord with the structure of claim 1 comprising the steps of:

generating a plasma containing anatyte ions;

substantially confining the plasma radially within the reaction zone of claim 1 whilst flowing it from a higher pressure region towards a lower pressure region;

supplying a substance directly into the substantially radially confined plasma to cause reactive or collisional interactions with polyatomic or multicharged interfering ions therein and thereby attenuate such polyatomic or multicharged ions;

and extracting an ion beam from the plasma for mass analysis of the analyte ions.

16. The method for plasma mass spectrometry as claimed in claim 15, wherein the substance is supplied into the substantially radially confined plasma so as to create a shockwave in the plasma to promote the rate of reactions or collisions for improving the attenuation of interfering ions.

17. The method for plasma mass spectrometry as claimed in claim 15, wherein the substance is supplied into the substantially radially confined plasma so as to cause substantial stagnation of the radially confined plasma without inducing a shock wave therein for increasing the residence time of the plasma whilst it is radially confined for improving the attenuation of interfering ions.

18. The method for plasma mass spectrometry as claimed in claim 15, wherein the substance is supplied into the substantially radially confined plasma so as to have a substantially zero radial speed component and an axial speed component substantially in the same direction as the plasma flow.

19. The method for plasma mass spectrometry as claimed in claim 18, wherein the axial speed component is substantially the same speed as the plasma.

20. The method for plasma mass spectrometry as claimed in claim 15, wherein the plasma is generated in argon and the supplied substance is hydrogen.

* * * * *